US010306944B1

(12) United States Patent
Ratliff

(10) Patent No.: US 10,306,944 B1
(45) Date of Patent: Jun. 4, 2019

(54) MODULAR HELMET APPARATUS AND SYSTEM

(71) Applicant: Dana Ratliff, Moncks Corner, SC (US)

(72) Inventor: Dana Ratliff, Moncks Corner, SC (US)

( * ) Notice: Subject to any disclaimer, the term of this patent is extended or adjusted under 35 U.S.C. 154(b) by 0 days.

(21) Appl. No.: 16/165,099

(22) Filed: Oct. 19, 2018

(51) Int. Cl.

| | |
|---|---|
| ***A42B 3/00*** | (2006.01) |
| ***A42B 3/32*** | (2006.01) |
| ***A42B 3/12*** | (2006.01) |
| ***A42B 3/20*** | (2006.01) |

(52) U.S. Cl.
CPC ..... *A42B 3/326* (2013.01); *A42B 3/125* (2013.01); *A42B 3/20* (2013.01)

(58) Field of Classification Search
CPC ..... A42B 3/00; A42B 3/069
USPC ..... 2/410, 416, 418, 424
See application file for complete search history.

(56) References Cited

U.S. PATENT DOCUMENTS

| | | | | |
|---|---|---|---|---|
| 3,815,152 | A | 6/1974 | Bednarczuk et al. | |
| 6,378,140 | B1 | 4/2002 | Abraham et al. | |
| 7,213,271 | B1 * | 5/2007 | Bielefeld | A42B 3/14 2/181 |
| 7,328,462 | B1 * | 2/2008 | Straus | A42B 3/067 2/411 |
| 7,565,704 | B2 * | 7/2009 | Wu | A42B 3/145 2/410 |
| 8,850,622 | B2 | 10/2014 | Finiel et al. | |
| 9,119,431 | B2 | 9/2015 | Bain | |
| 9,131,744 | B2 | 9/2015 | Erb et al. | |
| D752,821 | S | 3/2016 | Bologna | |
| 9,861,153 | B2 * | 1/2018 | Finisdore | A42B 3/069 |
| 9,907,347 | B2 | 3/2018 | Allen | |
| 2007/0157370 | A1 | 7/2007 | Joubert Des Ouches | |
| 2012/0317705 | A1 | 12/2012 | Lindsay | |
| 2017/0135433 | A1 | 5/2017 | Booher, Sr. et al. | |

* cited by examiner

*Primary Examiner* — Tajash D Patel
(74) *Attorney, Agent, or Firm* — Gregory Finch; Finch Paolino, LLC

(57) ABSTRACT

Embodiments of the present disclosure provide for a modular helmet apparatus and system comprised of a removable outer shell disposed on an inner frame. The disclosed football helmet provides for enhanced energy diffusion through the use of one or more energy diffusion areas disposed on an outer shell of the helmet, the one or more energy diffusion areas being configured to align with the energy diffusion zones of the frame. Embodiments of the present disclosure enables a user to quickly and easily replace or swap the outer shell of the helmet with a second or replacement shell by selectively coupling the desired outer shell with the frame.

20 Claims, 6 Drawing Sheets

MODULAR HELMET APPARATUS AND SYSTEM

FIELD

The present disclosure relates to the field of athletic equipment; in particular, a modular football helmet with a removable outer shell.

BACKGROUND

American football, which is one of the country's favorite pastimes, is also one of the most dangerous. The sport is characterized by high energy tackles and collisions that are conducive to a number of serious injuries, including mild to severe concussions and traumatic brain injury. In 2012, the National Football League (NFL) experienced a total of 189 concussions during its regular season, translating to more than 11 concussions each week.

Similarly, college football players experience an average of 2.5 concussions for every 1,000 game-related exposures, while 25,000 players between the ages of eight and nineteen are taken to emergency rooms for concussions each year. With the rates of these head injuries either increasing or stabilizing over the past 50 years, many health experts have started referring to a football-related "concussion epidemic." At the same time, the long-term consequences of head trauma experienced by football players have come under increasing scrutiny in recent years.

In the case of American football, while many attempts have been made to improve the design and safety of the players' helmets, the number of severe brain and other injuries continues to rise with participation in the sport, and with the increasing speed and power of the athletes. The hard outer shell of existing helmets frequently does little to absorb initial impact forces, and merely transfers the impact energy of collisions to the inner cushioning of the helmets. Accordingly, new and improved helmet designs are needed, in which the outer shell will more effectively absorb the energy of an impact, while maintaining the structural integrity of the helmet.

Through applied effort, ingenuity, and innovation, Applicant has identified a number of deficiencies and problems with football helmets. Applicant has developed a solution that is embodied by the present invention, which is described in detail below.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a modular helmet comprising a frame comprising a first frame section, a second frame section, and a third frame section, the first frame section extending from a front end to a rear end and defining a circumference of the frame, the second frame section extending from a left base portion to a right base portion at a first angle and defining a height of the frame, the third frame section extending from the left base portion to the right base portion at a second angle, the first frame section and the second frame section begin configured to define a frontal diffusion zone adjacent to the front end, and the first frame section and the third frame section being configured to define a rear diffusion zone adjacent to the rear end; and, a shell being configured to be removably coupled to the frame, the shell being configured to house the frame in an interior portion of the shell.

Another object of the present disclosure is a modular helmet comprising a frame comprising a first frame section, a second frame section, and a third frame section, the first frame section extending from a front end to a rear end and defining a circumference of the frame, the second frame section extending from a left base portion to a right base portion at a first angle and defining a height of the frame, the third frame section extending from the left base portion to the right base portion at a second angle, the first frame section and the second frame section begin configured to define a frontal diffusion zone adjacent to the front end, and the first frame section and the third frame section being configured to define a rear diffusion zone adjacent to the rear end; and, a shell being configured to be removably coupled to the frame, the shell being configured to house the frame in an interior portion of the shell, the shell comprising a first deformable area disposed on a forward portion of the shell, and a second deformable area disposed on a rear portion of the shell.

Yet another object of the present disclosure is a modular helmet system comprising a frame comprising a first frame section, a second frame section, and a third frame section, the first frame section extending from a front end to a rear end and defining a circumference of the frame, the second frame section extending from a left base portion to a right base portion at a first angle and defining a height of the frame, the third frame section extending from the left base portion to the right base portion at a second angle, the first frame section and the second frame section begin configured to define a frontal diffusion zone adjacent to the front end, and the first frame section and the third frame section being configured to define a rear diffusion zone adjacent to the rear end; a first shell being configured to be removably coupled to the frame, the first shell being configured to house the frame in an interior portion of the first shell; and, a second shell being configured to be removably coupled to the frame in place of the first shell, the second shell being configured to house the frame in an interior portion of the second shell.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
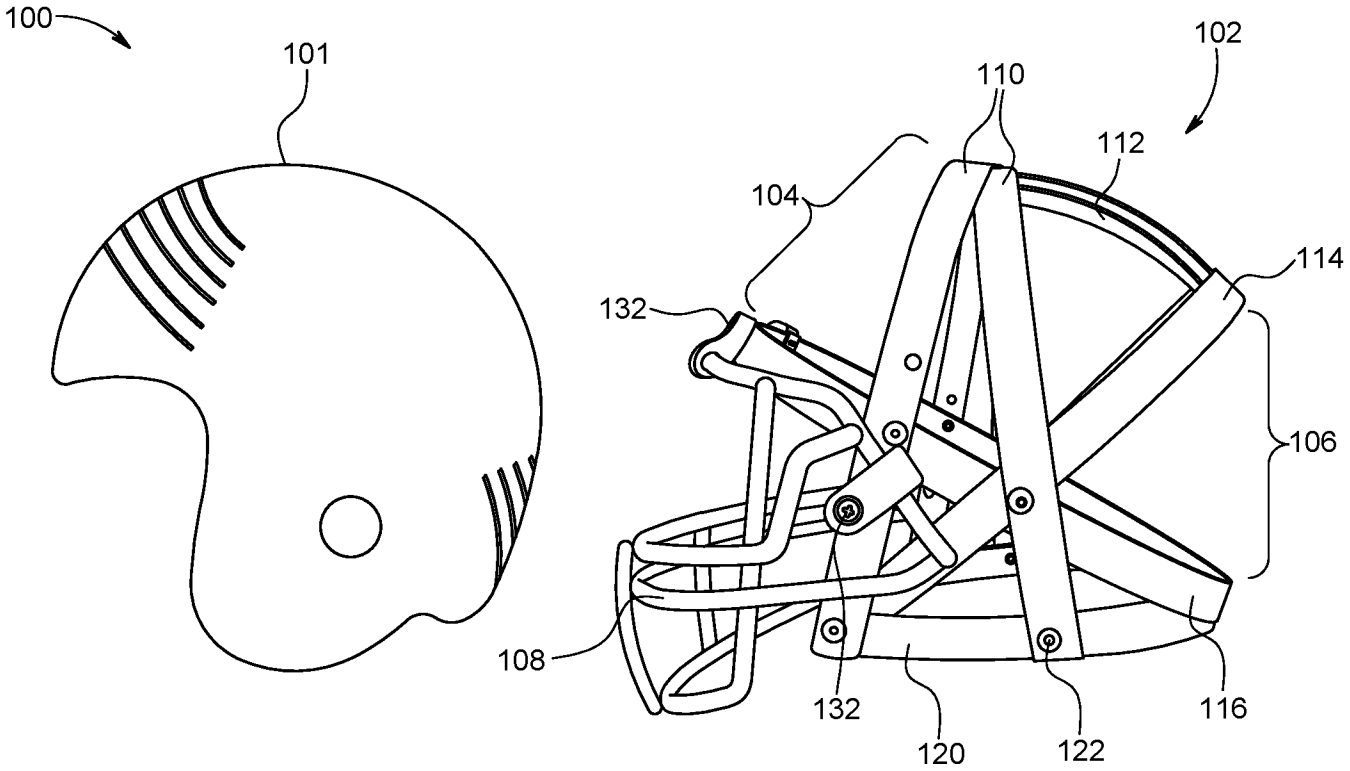
FIG. 1 is a perspective view of a modular helmet, according to an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Embodiments of the present disclosure provide for a modular football helmet apparatus and system. According to an embodiment, a modular football helmet apparatus and system is comprised of a frame and a removable shell. The disclosed modular football helmet apparatus and system provides advancements over the prior art by enabling a football helmet having at least a frontal diffusion zone and a rear diffusion zone. The purpose of the frontal diffusion zone and the rear diffusion zone is to provide for deformable areas in the forward and rear portions of the football helmet (i.e. the areas of the helmet most commonly exposed to hits during a football game). Prior art football helmets provide for a rigid polycarbonate outer shell with pillow-like padding disposed in the interior portion of the shell. The padding in the interior portion of the shell is relied upon as the primary means to transfer oncoming force received by the football helmet when taking a hit in the game of football. However, the rigid outer shell itself does little to transfer energy from the oncoming hit. Prior art solutions have experimented with various concepts for a football helmet with an outer shell having one or more energy transfer relief cuts. However, the need for structural integrity of the football helmet has caused prior art solutions to fall short of providing truly meaningful energy transfer solutions for the exterior shell of a football helmet, and interior pillow padding remains the primary means of energy diffusion in football helmets. Embodiment of the present disclosure provide for a modular football helmet apparatus and system that enables greatly improved energy transfer and diffusion at the shell of the football helmet, while still maintaining structural integrity of the entire helmet.

The modular football helmet apparatus and system of the present disclosure provides for a football helmet comprising a frame and a removable outer shell. The frame is defined by one or more frame portions, the framed portions having a form factor resembling that of a prior art football helmet. The frame is configured to define an empty zone in the front portion of the frame, and an empty zone at the rear portion of the frame. The empty zone at the front portion of the frame defines a frontal diffusion zone (where energy may be diffused by the exterior shell prior to reaching the interior pillow padding), and the empty zone at the rear portion of the frame defines a rear diffusion zone (where energy may be diffused by the exterior shell prior to reaching the interior pillow padding). The frame may also comprise empty zones on the left and right temporal portions of the frame, defining left and right energy diffusion zones. The outer shell may be fitted over top of the frame and selectively coupled to the frame using one or more bolts, screws, rivets, or other mechanical mating means. The outer shell may be constructive polycarbonate or a rubber or thermoplastic elastomeric material. The outer shell may have one or more relief cuts, apertures, or channels disposed on a foreword portion and a rear portion of the outer shell, defining energy diffusion areas. The relief cuts may define a deformable area on the forward portion and the rear portion of the outer shell. Alternatively, the deformable areas may be defined by one or more deformable or elastomeric materials such as rubber or thermoplastic elastomer having a Shore durometer between 20-00 and 80-00, such that the deformable area may provide for enhanced energy diffusion as compared to other portions of the outer shell. Embodiments where the deformable area(s) are defined by relief cuts, the deformable area(s) may further comprise an elastomeric or silicone-based filler being filled and bonded to the relief cuts to provide improved durability to the deformable area(s) while maintaining deformability and flexibility.

When in use, the modular football helmet provided by the present disclosure enables enhanced energy diffusion at the frontal and the rear portions of the helmet such that force from an oncoming hit to the helmet is substantially diffused at the point of contact, rather than being transferred and diffused by the interior pads of the helmet. If the exterior shell of a helmet is damaged during use, a user may simply remove the exterior shell of the helmet and replace it with a new exterior shell. It is anticipated that the frame of the helmet may include tracks, channels, or other mechanical mating elements to enable rapid removal and replacement of exterior shell on the frame. Likewise, it is anticipated that a modular helmet system may be comprised of multiple types outer shells that may define different physical characteristics. For example, a left tackle may have a helmet with an exterior shell having a different strength, weight, Shore durometer, material, and/or elasticity than that of a wide receiver's helmet. It is anticipated that different exterior shells may provide varying levels of deformability and protection from concussions, as well as different performance characteristics.

Referring now to FIG. 1, a perspective view of a modular football helmet 100 is shown. According to an embodiment of the present disclosure, modular football helmet 100 is generally comprised of a frame 102 and an outer shell 101. A face mask 108 may be removably coupled to frame 102 via one or more attachment portions 132. Modular football helmet 100 may further comprise an inner lining comprising a configuration of pillow padding for enhanced user comfort and energy diffusion. It is anticipated that the inner lining modular football helmet 100 will be substantially equivalent to that of prior art football helmet padding, and in the interest of brevity will not be discussed at length in the present disclosure. Outer shell 101 is removably coupled to frame 102 by placing outer shell 101 on top of frame 102, such that frame 102 is housed in an interior portion of outer shell 101. Outer shell 101 may be coupled to frame 102 via one or more attachment portions disposed on frame 102. Frame 102 may be generally comprised of a cranial frame portion 116, a frontal framed portion 110, and occipital frame portion 120, a temporal frame portion 114, and a parietal frame portion 112. It should be noted that the nomenclature of the aforementioned frame portions has been adopted to notate the areas of the skull to which the various portions of frame 102 are most closely configured to correspond, and should not be construed as limiting. Such terms are adopted solely for ease of reference. Cranial portion 116 extends from a front portion of frame 102 to a rear portion of frame 102 to define a circumference of frame 102. Occipital frame portion 120 extends laterally as an arc from a lower left side to a lower right side of frame 102, and defines a base of frame 102. Frontal frame portion 110 may extend vertically at an angle in the range of about 60 degrees to about 90 degrees from the left side of occipital frame portion 120 to the right side of occipital frame portion 120, and may be configured as an arc defining a vertex or height of frame 102. According to an embodiment, frontal frame portion 110 may be configured as a two-piece construction having a first portion coupled to an end of occipital frame portion 120 at a left side and a midportion of occipital frame portion 120 at a right side; and, a second portion coupled to an end of occipital frame portion 120 at a right side and mid portion of occipital frame 120 at a left side. Alternatively, frontal frame portion 110 may be configured as a one piece construction extending vertically to define an arc from a left end of occipital frame portion 120 to a right end of occipital frame portion 120. Temporal frame portion 114 may extend from a left end of occipital frame portion 120 to a right end of occipital frame portion 120 at an angle in the range of approximately 30 degrees to 60 degrees to define an arc. Frontal frame portion 110 and temporal frame portion 114 may be coupled together at an upper portion of frame 102 via parietal frame portion 112. As shown in FIG. 1, the area extending from cranial frame portion 116 to the upper end of frontal frame portion 110 defines frontal diffusion zone 104. The area extending from cranial frame portion 116 to the upper portion of temporal frame portion 114 defines rear diffusion zone 106. Frontal diffusion zone 104 and rear diffusion zone 106 are configured to enable outer shell 101 to bend and deform at these zones in order to diffuse the energy received through a strike to modular football helmet 100.

As shown in FIG. 1, frame 102 may be constructed of aluminum or metal extrusions that are formed to correspond to the contours of the interior portion of outer shell 101. The various portions of frame 102 may be coupled together through the use of rivets 122. Alternatively, frame 102 may be constructed as a single piece construction by welding together the various components of frame 102. Frame 102 may be constructed of various metals, alloys, fibers, and other materials of similar tensile strength, such as steel, aluminum, titanium, and the like.

Figure 2:
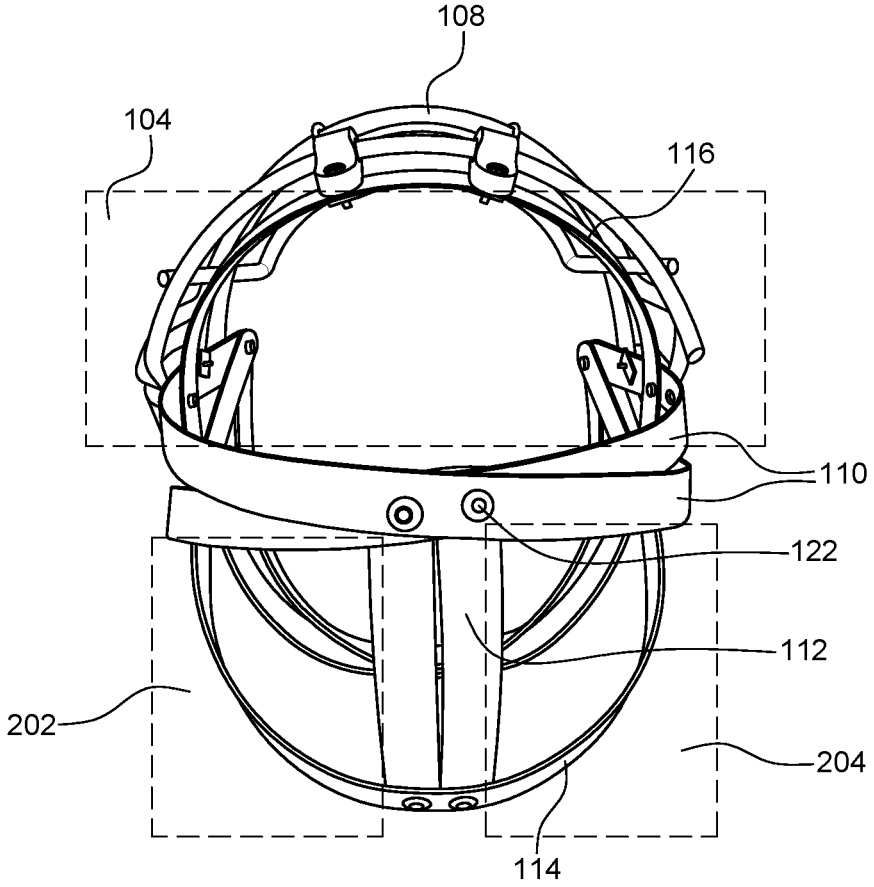
FIG. 2 is a perspective view of a modular helmet, according to an embodiment of the present disclosure.

Referring now to FIG. 2, a top-down perspective of modular football helmet 100 is shown. According to an embodiment, frontal diffusion zone 104 extends from frontal frame portion 110 to cranial frame portion 116. Frame 102 may further comprise a left diffusion zone 202 and a right diffusion zone 204. Left diffusion zone 202 may be defined by the area extending from frontal face portion 110 to the left side of parietal frame portion 112, to cranial frame portion 116. Right diffusion zone 204 may be defined by the area extending from frontal frame portion 110, to the right side of parietal frame portion 112, to cranial frame portion 116. Left diffusion zone 202 and the right diffusion zone 204 may comprise additional zones for enhanced energy diffusion from outer shell 101.

Figure 3:
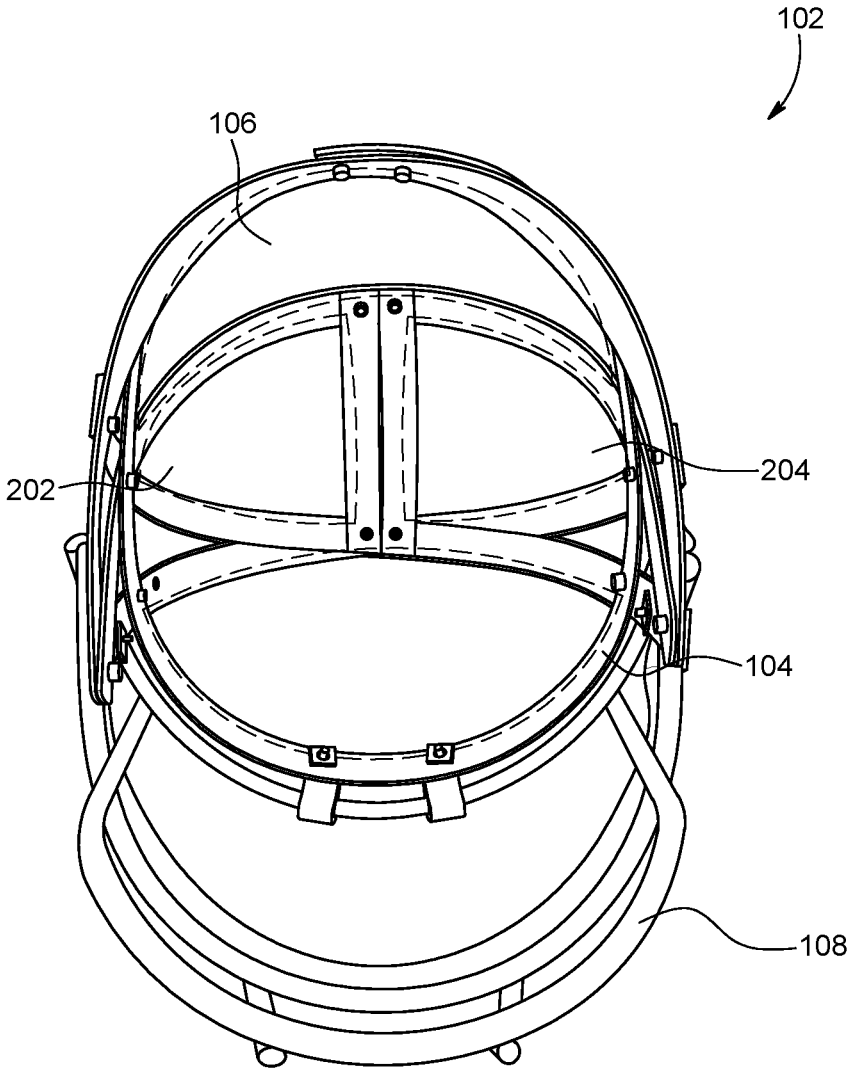
FIG. 3 is a perspective view of a modular helmet, according to an embodiment of the present disclosure.

Referring now to FIG. 3, a bottom-up view of modular football helmet 100 is shown. As shown in the present embodiment, frame portion 102 defines frontal diffusion zone 104, rear diffusion zone 106, left the fusion zone 202, and right diffusion zone 204. As shown in this embodiment, frame portion 102 provides structural integrity for helmet 100 while enabling enhanced energy diffusion from outer shell 101 through the use of frontal diffusion zone 104, rear diffusion zone 106, left the fusion zone 202, and right diffusion zone 204.

Figure 4:
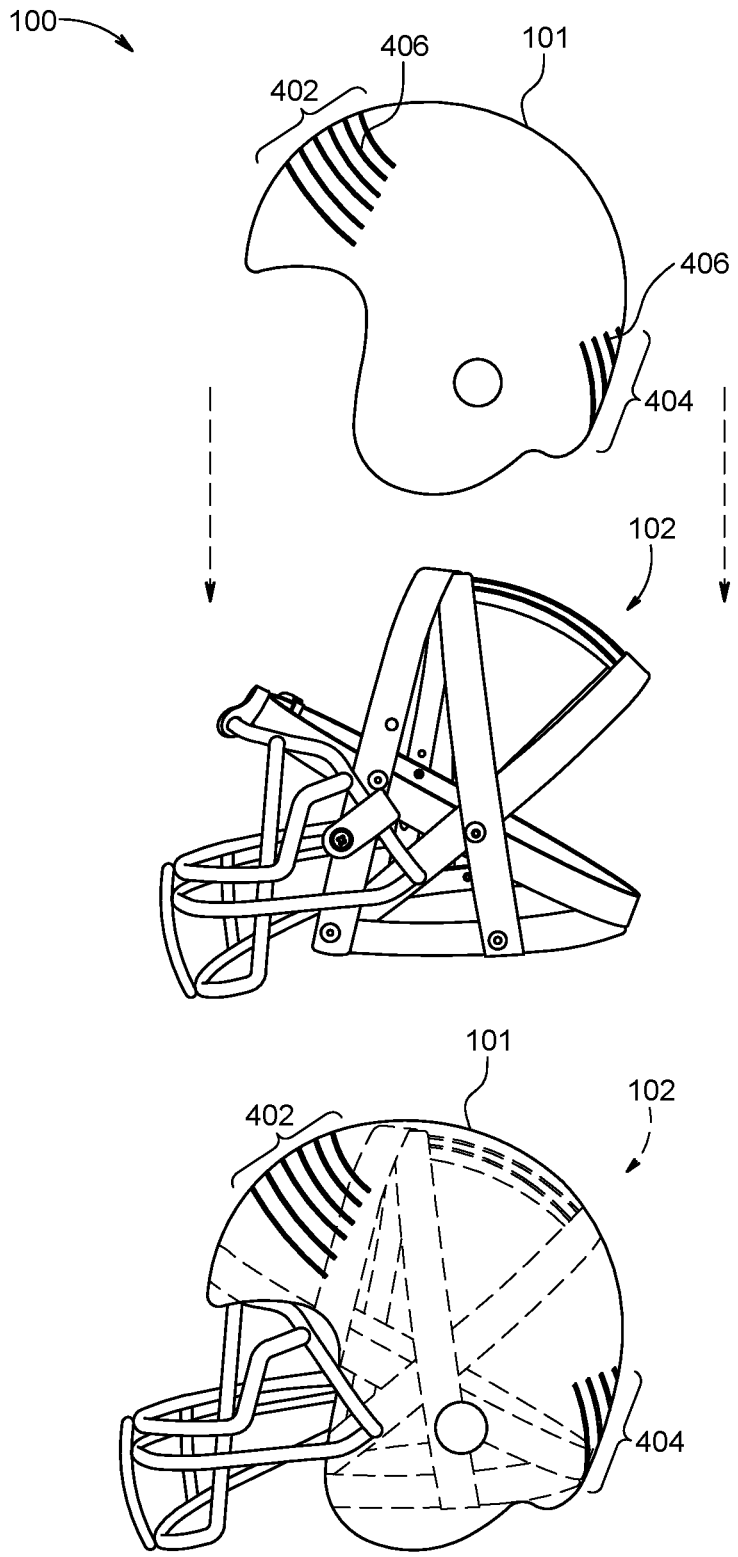
FIG. 4 is a functional diagram of a modular helmet, according to an embodiment of the present disclosure.

Referring now to FIG. 4, a functional diagram of modular football helmet 100 is shown. According to an embodiment of the present disclosure, outer shell 101 is selectively coupled to frame 102. As discussed above, outer shell 101 may be constructed of a polycarbonate, rubber, thermoplastic material, carbon fiber, or other material of like physical characteristics. Outer shell 101 may have a form factor substantially similar to that of the prior art football helmets. Outer shell 101 may be comprised of front diffusion area 402 and rear diffusion area 404. Front diffusion area 402 and rear diffusion area 404 may be defined by a plurality of relief cuts, channels, or other apertures 406 being disposed on the exterior of outer shell 101. Front diffusion area 402 and rear diffusion area 404 are configured such that when pressure is applied to either area, the area is displaced laterally and otherwise is deformed or moved in order to transfer and diffuse energy. Force applied to front diffusion area 402 or rear diffusion area 404 is diffused laterally such that energy is substantially transferred and diffused across the entirety of front diffusion area 402 or rear diffusion area 404 prior to reaching the interior padding of helmet 100. According to an embodiment, apertures 406 may be filled with a silicone or an elastomeric material in order to enhance the durability front diffusion area 402 and/or rear diffusion area 404. In an alternative embodiment, apertures 406 may be replaced with an energy absorbing material with similar energy diffusion characteristics. For example, front diffusion area 402 and/or rear diffusion area 404 may comprise a rubber or thermoplastic elastomeric material having a Shore durometer in the range of about 20-00 to about 60-00, or other energy absorbing material or padding. Still further, outer shell 101 may be entirely constructed of a rubber or thermoplastic elastomeric material having a Shore durometer in the range of about 20-00 to about 80-00.

Figure 5:
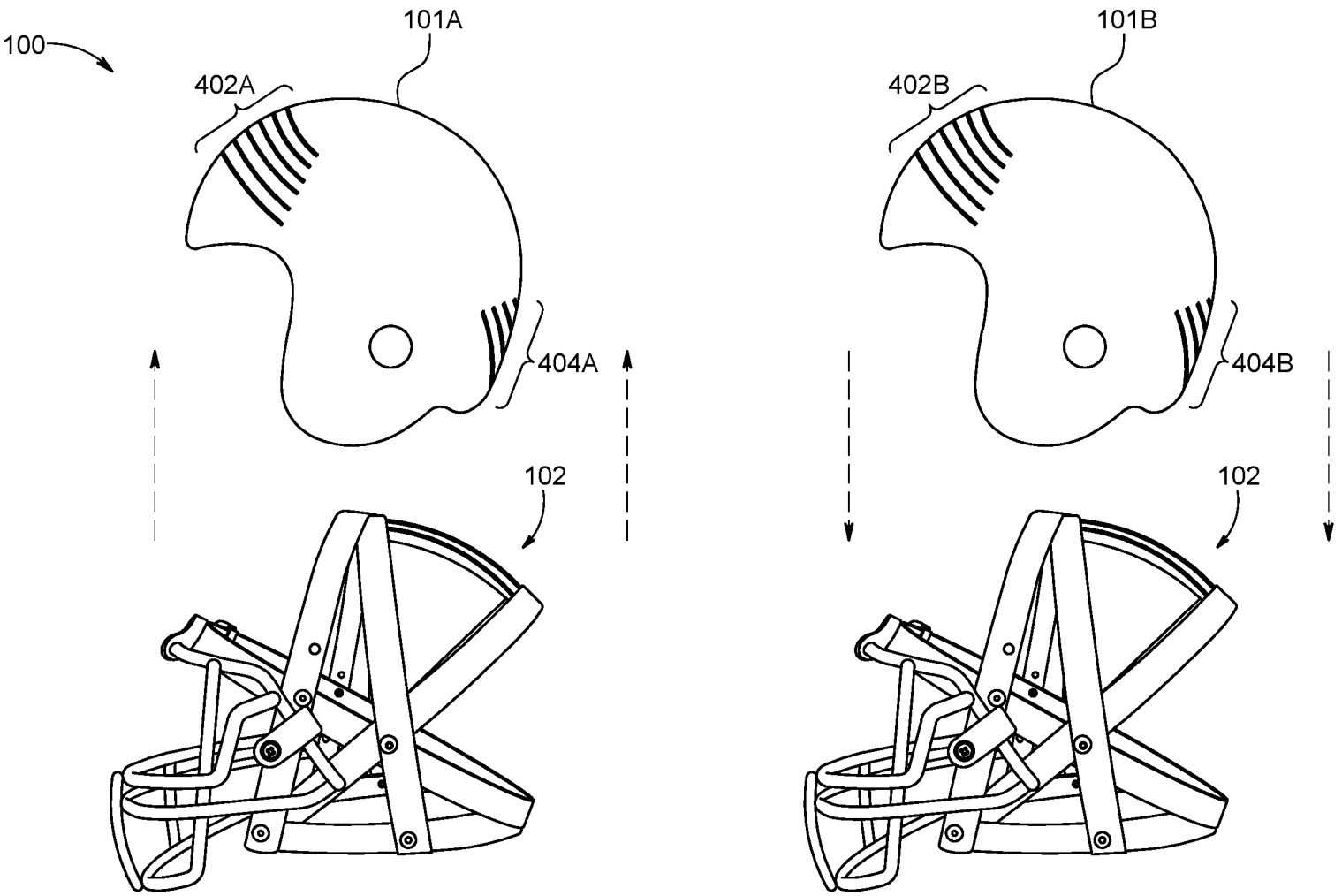
FIG. 5 is a functional diagram of a modular helmet, according to an embodiment of the present disclosure.

Referring now to FIG. 5, a functional diagram of modular football helmet 100 is shown. According to an embodiment of the present disclosure, modular football helmet 100 may comprise a first outer shell 101A and a second outer shell 1016. A user may selectively replace first outer shell 101A with second outer shell 1016. The user may selectively replace first outer shell 101A with second outer shell 101B by disconnecting outer shell 101A from frame 102. This may be done by removing one or more screws that are used to couple outer shell 101A to frame 102. Likewise, one or more mechanical or other attachment means may be used to selectively couple and disconnect outer shell 101A from frame 102. The user may selectively replace first outer shell 101A with second outer shell 101B in response to first outer shell 101A being damaged during use; for example, numerous strikes to outer shell 101A during the football game may result in structural damage to front diffusion area 402 and/or rear diffusion area 404 necessitating replacement of outer shell 101A. In certain embodiments, outer shell 101A and outer shell 101B may comprise different physical characteristics. For example, front diffusion area 402A and rear diffusion area 404A may be configured to comprise specified strength, elasticity and other performance characteristics.

This may be attained by the size and number of apertures 406A, and/or the materials, configuration, and other design aspects of front diffusion area 402A and rear diffusion area 404A. Front diffusion area 402B and rear diffusion area 404B may be configured to comprise one or more alternative strength, elasticity, deformability and/or other performance characteristics. In certain embodiments, varying performance characteristics may be attained by varying the size and number of apertures 406B from the size and number of apertures 406A, as well as incorporating one or more combinations of alternative the materials, configurations, and/or other design aspects of front diffusion area 402B and rear diffusion area 404B, as compared to front diffusion area 402A and rear diffusion area 404A. This enables a user to change performance aspects of a player's helmet during the course of a football game. As an illustrative example, a football player may play multiple positions between offense and defense; such as linebacker during defense, and tight end during offense. Such a player may desire certain characteristics of his helmet while playing a defensive position, and other characteristics of his helmet when playing an offense of position. The removability and configurability of helmet 100, as described above, enables the player to quickly change outer shell 101 to attain that player's desired helmet characteristics.

Figure 7:
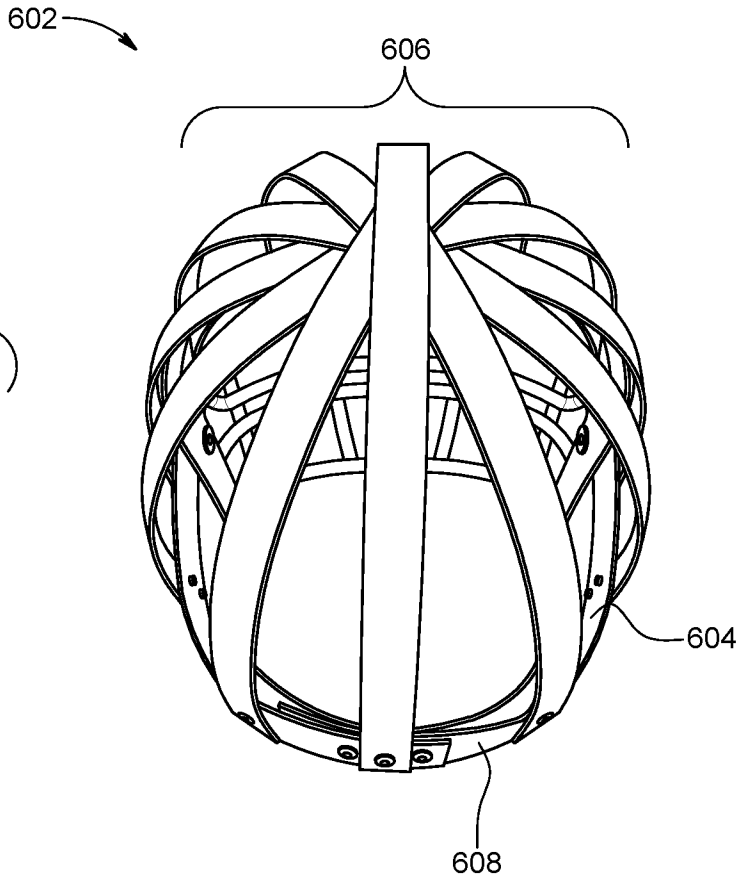
Figure 6:
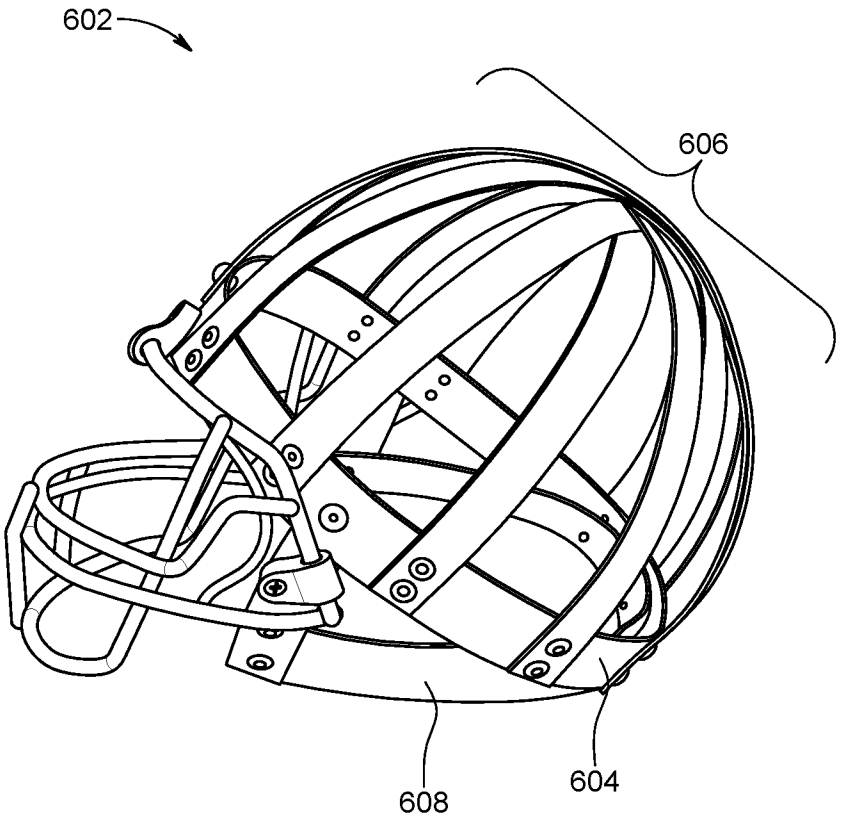
FIG. 6 is a perspective view of a modular helmet frame, according to an embodiment of the present disclosure; and, FIG. 7 is a perspective view of a modular helmet frame, according to an embodiment of the present disclosure.

Referring now to FIGS. 6 and 7, a perspective view of a modular football helmet frame 602. According to an embodiment of the present disclosure, frame 602 is generally comprised of cranial portion 604, base portion 608, and crown portion 606. Crown portion 606 may be comprised of a plurality of ribs 610. The plurality of ribs 610 maybe coupled around the circumference of cranial portion 604 at a first and second end of each rib 610. The plurality of ribs 610 may overlap to form the shape of crown portion 606. Each rib in the plurality of ribs 610 may be configured to be movable along the length of each rib, such that when force is applied to crown portion 606 the plurality of ribs 610 are movable to diffuse the force. Ribs 610 may be constructed of a shape memory alloy, smart metal, memory metal, memory alloy, muscle wire, smart alloy, or other deformable metal or non-metal material such that ribs 610 may deform in response to receiving force in order to diffuse energy. A shape-memory alloy may include any alloy that "remembers" its original shape and that when deformed returns to its pre-deformed shape when heated. According to an alternative embodiment, crown portion 606 may be constructed as a unitary construction as opposed to a construction incorporating ribs or a frame. In such embodiment, crown portion would be constructed of a deformable or energy diffusing material such as shape memory alloy, rubber, foam, and the like.

Embodiments of the present disclosure provide for advancements over the prior art by enabling a modular football helmet apparatus and system that provides for structural integrity through the use of a specially adapted frame comprising one or more energy diffusion zones, as well as enhanced energy diffusion through the use of one or more energy diffusion areas disposed on an outer shell of the helmet in alignment with one or more energy diffusion zones of the frame. The user can quickly and easily replace or swap the outer shell of the helmet by decoupling the outer shell from the frame, and replacing a first outer shell with a second or replacement outer shell.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A modular helmet comprising:

a frame comprising a first frame section, a second frame section, and a third frame section, the first frame section extending from a front end to a rear end and defining a circumference of the frame, the second frame section extending from a left base portion to a right base portion at a first angle and defining a height of the frame, the third frame section extending from the left base portion to the right base portion at a second angle, the first frame section and the second frame section being configured to define a frontal diffusion zone adjacent to the front end, and the first frame section and the third frame section being configured to define a rear diffusion zone adjacent to the rear end, the first frame section, the second frame section, and the third frame section being substantially spaced apart from each other; and, a shell being configured to be removably coupled to the frame, the shell being configured to house the frame in an interior portion of the shell.

2. The modular helmet of claim 1 wherein the shell comprises a first deformable area, the first deformable area being disposed on the shell such that the first deformable area is located adjacent to the frontal diffusion zone of the frame when the shell is removably coupled to the frame.

3. The modular helmet of claim 1 wherein the shell comprises a second deformable area, the second deformable area being disposed on the shell such that the second deformable area is located adjacent to the rear diffusion zone of the frame when the shell is removably coupled to the frame.

4. The modular helmet of claim 1 wherein the frame further comprises a fourth frame section, the fourth frame section extending from the left base portion to the right base portion, and being coupled to the first frame section at the rear end.

5. The modular helmet of claim 1 further comprising a face mask removably coupled to the frame.

6. The modular helmet of claim 1 wherein the shell is constructed, at least in part, of a rubber or plastic material having a Shore durometer in the range of 30-00 to 80-00.

7. The modular helmet of claim 2 wherein the first deformable area comprises a plurality of apertures.

8. The modular helmet of claim 3 wherein the second deformable area comprises a plurality of apertures.

9. A modular helmet comprising:

a frame comprising a first frame section, a second frame section, and a third frame section, the first frame section extending from a front end to a rear end and defining a circumference of the frame, the second frame section extending from a left base portion to a right base portion at a first angle and defining a height of the frame, the third frame section extending from the left base portion to the right base portion at a second angle, the first frame section and the second frame section being configured to define a frontal diffusion zone adjacent to the front end, and the first frame section and the third frame section being configured to define a rear diffusion zone adjacent to the rear end, the first frame section, the second frame section, and the third frame section being substantially spaced apart from each other; and, a shell being configured to be removably coupled to the frame, the shell being configured to house the frame in an interior portion of the shell, the shell comprising a first deformable area disposed on a forward portion of the shell, and a second deformable area disposed on a rear portion of the shell.

10. The modular football helmet of claim 9 further comprising a face mask removably coupled to the frame.

11. The modular helmet of claim 9 wherein the first deformable area is disposed on the forward portion of the shell such that the first deformable area is located adjacent to the frontal diffusion zone of the frame when the shell is removably coupled to the frame.

12. The modular helmet of claim 9 wherein the second deformable area is disposed on the rear portion of the shell such that the second deformable area is located adjacent to the rear diffusion zone of the frame when the shell is removably coupled to the frame.

13. The modular helmet of claim 9 wherein the shell is constructed, at least in part, of a rubber or plastic material having a Shore durometer in the range of 30-00 to 80-00.

14. The modular helmet of claim 9 wherein the first deformable area and the second deformable area comprise a plurality of apertures.

15. The modular helmet of claim 14 further comprising a filler material being bonded to the plurality of apertures at the first deformable area and the second deformable area.

16. A modular helmet system comprising:

a frame comprising a first frame section, a second frame section, and a third frame section, the first frame section extending from a front end to a rear end and defining a circumference of the frame, the second frame section extending from a left base portion to a right base portion at a first angle and defining a height of the frame, the third frame section extending from the left base portion to the right base portion at a second angle, the first frame section and the second frame section being configured to define a frontal diffusion zone adjacent to the front end, and the first frame section and the third frame section being configured to define a rear diffusion zone adjacent to the rear end, the first frame section, the second frame section, and the third frame section being substantially spaced apart from each other;

a first shell being configured to be removably coupled to the frame, the first shell being configured to house the frame in an interior portion of the first shell; and, a second shell being configured to be removably coupled to the frame in place of the first shell, the second shell being configured to house the frame in an interior portion of the second shell.

17. The modular helmet of claim 16 wherein the first shell is constructed to have a first strength and the second shell is constructed to have a second strength.

18. The modular helmet of claim 16 wherein the first shell further comprises at least one deformable area disposed on a forward portion of the first shell.

19. The modular helmet of claim 16 further comprising a face mask removably coupled to the frame.

20. The modular helmet of claim 16 wherein the first shell is constructed to have a first weight and the second shell is constructed to have a second weight.

* * * * *